US011319675B2

(12) United States Patent
Wang et al.

(10) Patent No.: US 11,319,675 B2
(45) Date of Patent: May 3, 2022

(54) ARAMID NANOFIBER-BASED INSULATION PAPER AND PREPARATION METHOD THEREOF

(71) Applicant: Hunan University, Hunan Province (CN)

(72) Inventors: Jianfeng Wang, Hunan Province (CN); Fanzhan Zeng, Hunan Province (CN); Guang Xiao, Hunan Province (CN)

(73) Assignee: Hunan University, Hunan Province (CN)

( * ) Notice: Subject to any disclaimer, the term of this patent is extended or adjusted under 35 U.S.C. 154(b) by 117 days.

(21) Appl. No.: 16/943,756

(22) Filed: Jul. 30, 2020

(65) Prior Publication Data

US 2021/0062429 A1 Mar. 4, 2021

(30) Foreign Application Priority Data

Aug. 26, 2019 (CN) ..... 201910789235.6

(51) Int. Cl.

| | |
|---|---|
| ***D21H 27/00*** | (2006.01) |
| ***D21D 5/00*** | (2006.01) |
| ***D21F 11/00*** | (2006.01) |
| ***D21H 13/26*** | (2006.01) |
| ***D21H 17/67*** | (2006.01) |
| ***D21H 17/68*** | (2006.01) |
| ***D21H 21/34*** | (2006.01) |
| ***D21H 23/04*** | (2006.01) |

(52) U.S. Cl.

CPC ..... *D21H 27/00* (2013.01); *D21D 5/00* (2013.01); *D21F 11/00* (2013.01); *D21H 13/26* (2013.01); *D21H 17/67* (2013.01); *D21H 17/68* (2013.01); *D21H 21/34* (2013.01); *D21H 23/04* (2013.01)

(58) Field of Classification Search

USPC ..... 162/138

See application file for complete search history.

(56) References Cited

U.S. PATENT DOCUMENTS

| | | | | |
|---|---|---|---|---|
| 2013/0112625 | A1* | 5/2013 | Bahukudumbi | B01J 20/28007 210/660 |
| 2013/0115837 | A1* | 5/2013 | Kitchen | D04H 3/16 442/60 |
| 2021/0254286 | A1* | 8/2021 | Zhang | D21H 15/02 |

* cited by examiner

*Primary Examiner* — Mark Halpern

(74) *Attorney, Agent, or Firm* — Cesari & McKenna, LLP

(57) ABSTRACT

The present invention provides an aramid nanofiber (ANF)-based insulation paper and a preparation method thereof, and relates to the technical field of composite insulation material. The ANF-based insulation paper provided in the present invention includes ANFs and inorganic insulation materials. The ANFs have a bifurcated geometry and form a three-dimensional network structure, and the inorganic insulation materials are distributed in the three-dimensional network structure. The ANF paper provided in the present invention, with optimal electrical and mechanical properties and excellent insulation and flame-resistance, can replace mica tapes, aramid papers and aramid mica papers on the current market for insulation, and thus the thickness for insulation can be reduced. The present invention provides a method for preparing the ANF-based insulation paper. The preparation method provided in the present invention is simple, has excellent operability, and can be used for continuous preparation, thereby facilitating the realization of industrial production.

20 Claims, 3 Drawing Sheets

ARAMID NANOFIBER-BASED INSULATION PAPER AND PREPARATION METHOD THEREOF

CROSS REFERENCE TO RELATED APPLICATIONS

This application claims priority to Chinese Application No. 201910789235.6, filed on Aug. 26, 2019, the content of this application being hereby incorporated by reference in its entirety.

TECHNICAL FIELD

The present invention relates to the technical field of composite insulation materials, and in particular to an aramid nanofiber (ANF)-based insulation paper and a preparation method thereof.

BACKGROUND

In recent years, with the rapid development of capacitors and power transmission equipment, more and more attention has been paid to materials that have excellent insulation properties and mechanical properties under extreme conditions. At present, mica tape is the most widely used material for motor insulation. As mica itself has excellent electrical properties, high temperature resistance and a wide range of sources, it is suitable for the main body of inorganic insulation material. For example, muscovite, with a dielectric strength of 133 kV/mm to 407 kV/mm, can be used at a maximum temperature of 700° C. to 900° C. However, the insulation paper made of mica has a too-low mechanical strength, and thus cannot be directly used for electrical insulation, which requires additionally binding reinforcing materials to the insulation paper with an adhesive to form a mica tape. The adhesive, which is usually a polymer material such as resin, has an ordinary electrical strength and poor heat resistance. As a result, the mica tape has restricted electrical properties at the high operation temperature of the motor. Therefore, it is of great significance to prepare a mica composite material that integrates insulation properties, mechanical properties and heat resistance together to replace conventional mica tapes.

Aramid fibers can be used to reinforce the mica paper, which can improve the mechanical properties of the paper while ensuring the electrical properties of the paper. However, currently used for reinforcing the mica paper are micron-scale aramid fibers, which cannot well bind to the surface of mica due to a small specific surface area, and cannot significantly improve the mechanical properties. Therefore, the use of the micron-scale aramid fiber-based composite paper as an insulation material cannot completely replace the application of mica tapes in insulation. In order to improve the properties of the aramid fiber-reinforced mica paper, some workers introduce surface modification in aramid fibers and mica to enhance the interface binding between aramid fibers and mica. These composite materials prepared by modification have improved mechanical and electrical properties, but the introduction of modifiers increases the complexity and instability of the production process, and the conditions for industrial production cannot be met.

Therefore, it remains a challenge to design a composite insulation material based on aramid fibers and inorganic insulation materials that can replace mica tapes.

SUMMARY

In view of this, the present invention is intended to provide an ANF-based insulation paper and a preparation method thereof. The ANF-based insulation paper provided in the present invention, with optimal electrical and mechanical properties and excellent insulation and flame resistance, can replace mica tapes on the current market for insulation.

To achieve the above purpose, the present invention provides the following technical solution.

An ANF-based insulation paper, including ANFs and inorganic insulation materials is provided, where the ANFs have a bifurcated geometry and form a three-dimensional network structure, and the inorganic insulation materials are distributed in the three-dimensional network structure.

Preferably, the ANFs include para-aramid fibers and/or meta-aramid fibers, and have a diameter of 3 nm to 20 nm.

Preferably, the inorganic insulation materials include one or more of muscovite, phlogopite, fluorophlogopite, synthetic mica and boron nitride, and account for 30% to 70% of the mass of the ANF-based insulation paper.

A method for preparing the above ANF-based insulation paper is provided, including the following steps:

(1) mixing a strong alkali, dimethyl sulfoxide and aramid fibers to obtain a dispersion of ANFs;

(2) mixing dimethyl sulfoxide and inorganic insulation materials to obtain a dispersion of inorganic insulation materials;

(3) mixing the dispersion of ANFs and the dispersion of inorganic insulation materials to obtain a sol;

(4) performing solvent exchange on the sol with water to obtain a hydrogel; and (5) drying the hydrogel to obtain an ANF-based insulation paper;

where, steps (1) and (2) can be performed in any order.

Preferably, the strong alkali in step (1) is one or more of potassium hydroxide, potassium ethoxide and potassium tert-butoxide; the strong alkali and dimethyl sulfoxide are used at a mass ratio of 1:(9-300); and the strong alkali and aramid fibers are used at a mass ratio of 1:(1-3).

Preferably, in step (2), dimethyl sulfoxide and inorganic insulation materials are used at a mass ratio of 1:(0.003-0.05).

Preferably, in step (3), the dispersion of ANFs and the dispersion of inorganic insulation materials are used at a mass ratio of 1:(0.5-3).

Preferably, the performing solvent exchange on the sol with water in step (4) specifically includes: pouring the sol into a mold and then immersing the mold in water for solvent exchange; or, letting the sol pass through a continuous injection device for solvent exchange with water.

Preferably, the continuous injection device includes an injector, an outlet mold, a conveyor belt, and a sink, where the outlet of the injector communicates with the inlet of the outlet mold, the outlet of the outlet mold is close to the conveyor belt, and the outlet mold and the conveyor belt are disposed in the sink;

and in application, the sol is continuously injected through the injector; the solvent is exchanged with water in the sink after the sol flows through the outlet mold; and the formed hydrogel is transferred out of the sink by the conveyor belt.

Preferably, the drying in step (5) is performed at 25° C. to 40° C. for 48 h to 120 h.

The present invention provides an ANF-based insulation paper, including ANFs and inorganic insulation materials. The ANFs have a bifurcated geometry and form a three-dimensional network structure, and the inorganic insulation materials are distributed in the three-dimensional network structure. The ANFs in the ANF-based insulation paper provided in the present invention form a three-dimensional network structure, and the inorganic insulation materials are distributed in the three-dimensional network structure. When the insulation paper is stretched, the inorganic insulation materials slide with the non-uniform (apertures in the fiber network have different sizes) ANF network and are pulled out from the crimped ANFs, and the hydrogen bonding among ANFs will be destroyed. Therefore, the elongation and orientation of the ANF network will cause local deformation and hardening of the insulation paper. Moreover, due to the high interconnectivity of the ANF network and the multi-site crosslinking of the ANF network with inorganic insulation materials, the entire material will be uniformly deformed, rather than locally deformed, resulting in large fracture strain and ultra-high toughness. In addition, as ANFs replace some of the inorganic insulation materials, the formation of a fiber network in the paper enables the paper to have better mechanical properties. Furthermore, owing to the high insulation of aramid fibers, the obtained paper has excellent insulation. The results of examples show that compared with dry mica tapes and aramid mica papers commonly used at present, the ANF-based insulation paper provided in the present invention has significantly-improved dielectric strength and tensile strength, indicating that the ANF-based insulation paper provided in the present invention has excellent electrical properties, insulation properties and mechanical properties, and can replace mica tapes and aramid mica papers on the current market for insulation, and thus the thickness for insulation can be reduced.

The present invention provides a method for preparing the ANF-based insulation paper. The preparation method provided in the present invention is simple, has excellent operability, and can be used for continuous preparation, thereby facilitating the realization of industrial production.

DETAILED DESCRIPTION

Figure 1:
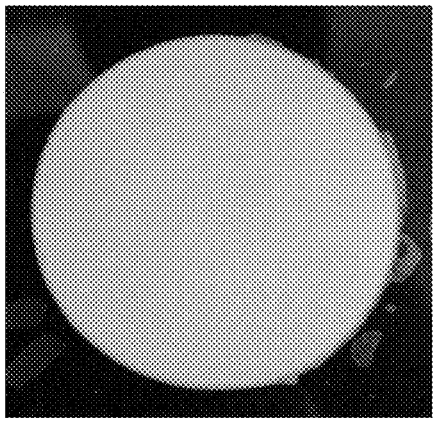
FIG. 1 is a physical appearance view of the para-ANF/synthetic mica hydrogel prepared in Example 1.

The present invention provides an ANF-based insulation paper, including ANFs and inorganic insulation materials. The ANFs have a bifurcated geometry (similar to a branched structure) and form a three-dimensional network structure, and the inorganic insulation materials are distributed in the three-dimensional network structure.

In the present invention, the ANFs preferably include para-aramid fibers and/or meta-aramid fibers, and have a diameter preferably of 3 nm to 20 nm, and more preferably of 10 nm.

In the present invention, the inorganic insulation materials preferably include one or more of muscovite, phlogopite, fluorophlogopite, synthetic mica and boron nitride, and account for, preferably 30% to 70%, and more preferably 40% to 60% of the mass of the ANF-based insulation paper. In the present invention, the inorganic insulation materials may be nanosheets or microsheets.

The present invention provides the aforementioned ANF-based insulation paper. The ANF-based insulation paper provided in the present invention, with optimal electrical and mechanical properties and excellent insulation and flame-resistance, can replace mica tapes, aramid papers and aramid mica papers on the current market for insulation, and thus the thickness for insulation can be reduced.

The present invention provides a method for preparing the ANF-based insulation paper in the above solution, including the following steps:

(1) mixing a strong alkali, dimethyl sulfoxide and aramid fibers to obtain a dispersion of ANFs;

(2) mixing dimethyl sulfoxide and inorganic insulation materials to obtain a dispersion of inorganic insulation materials;

(3) mixing the dispersion of ANFs and the dispersion of inorganic insulation materials to obtain a sol;

(4) performing solvent exchange on the sol with water to obtain a hydrogel; and (5) drying the hydrogel to obtain an ANF-based insulation paper;

where, steps (1) and (2) can be performed in any order.

In the present invention, a strong alkali, dimethyl sulfoxide and aramid fibers are mixed to obtain a dispersion of ANFs. In the present invention, the strong alkali is preferably one or more of potassium hydroxide, potassium ethoxide and potassium tert-butoxide; the strong alkali and dimethyl sulfoxide are used at a mass ratio preferably of 1:(9-300), and more preferably of 1:(100-200); and the strong alkali and aramid fibers are used at a mass ratio preferably of 1:(1-3), and more preferably of 1:(1.5-2). The present invention has no special requirements for the sources of the strong alkali and dimethyl sulfoxide, and corresponding products commercially available in the art may be used. In a specific embodiment of the present invention, the strong alkali preferably has a mass concentration≥99.0%; and the dimethyl sulfoxide preferably has a mass concentration≥99.5%. In the present invention, the aramid fibers are of the same kind as the ANFs described in the above solution, and will not be further described herein. The present invention has no special requirements for the source of aramid fibers, and aramid fibers commercially available in the art may be used. In the present invention, preferably, the strong alkali and dimethyl sulfoxide are first mixed to obtain an alkaline mixed solution; and then the alkaline mixed solution is mixed with aramid fibers. The present invention has no special requirements for the mixing manner of the strong alkali and dimethyl sulfoxide, provided that the strong alkali and dimethyl sulfoxide are mixed thoroughly. In the present invention, the alkaline mixed solution and aramid fibers are mixed, preferably under stirring, and preferably for 48 h to 72 h. The alkaline mixed solution and aramid fibers are mixed to obtain a dispersion of ANFs. The ANFs in the dispersion of ANFs have a diameter preferably of 3 nm to 20 nm, and more preferably of 10 nm; and have a length preferably of 1 μm to 10 μm, and more preferably of 5 μm. In the present invention, a strong alkali, dimethyl sulfoxide and aramid fibers are mixed. In the system of strong alkali/dimethyl sulfoxide, aramid fibers are delaminated from micron-scale to nano-scale, and form a bifurcated geometry. A three-dimensional network structure is formed by ANFs.

In the present invention, dimethyl sulfoxide and inorganic insulation materials are mixed to obtain a dispersion of inorganic insulation materials. In the present invention, the dimethyl sulfoxide and inorganic insulation materials are used at a mass ratio preferably of 1:(0.003-0.05), and more preferably of 1:(0.01-0.03); and the inorganic insulation materials are of the same kind as the inorganic insulation materials described in the above solution, and will not be further described herein. In the present invention, dimethyl sulfoxide and inorganic insulation materials are mixed preferably under stirring. The present invention has no special requirements for the time and speed of the stirring, provided that dimethyl sulfoxide and inorganic insulation materials are mixed thoroughly.

In the present invention, after a dispersion of ANFs and a dispersion of inorganic insulation materials are obtained, the dispersion of ANFs and the dispersion of inorganic insulation materials are mixed to obtain a sol. In the present invention, the dispersion of ANFs and the dispersion of inorganic insulation materials are used at a mass ratio preferably of 1:(0.5-3), and more preferably of 1:(1-2). In the present invention, the dispersion of ANFs and the dispersion of inorganic insulation materials are mixed preferably under stirring. The present invention has no special requirements for the time and speed of the stirring, provided that the dispersions can be mixed thoroughly to obtain a sol.

In the present invention, solvent exchange is performed on the sol with water to obtain a hydrogel. In the present invention, the specific operation for performing solvent exchange on the sol with water preferably includes: pouring the sol into a mold and then immersing the mold in water for solvent exchange; or, letting the sol pass through a continuous injection device for solvent exchange with water. In the present invention, during the solvent exchange process, the strong alkali and dimethyl sulfoxide in the sol are replaced by water, that is, the strong alkali and dimethyl sulfoxide in the sol diffuse into water, and water diffuses into the sol, and then the sol is converted into a hydrogel.

In the present invention, the operation of pouring the sol into a mold and then immersing the mold in water for solvent exchange is a batch preparation method. In the present invention, the sol is poured into a mold, and the sol will be spread out in the mold to form a thin film. The present invention has no special requirements for the shape and specification of the mold, and a mold for preparing a thin film well known in the art may be used. In a specific embodiment of the present invention, the mold is preferably a flat-bottom mold, so as to obtain a thin film with a uniform thickness. After the sol is poured into the mold, the mold spread with the sol is immersed in water for solvent exchange. The present invention has no special requirements for the number of times for solvent exchange, provided that the strong alkali and dimethyl sulfoxide in the sol can be completely replaced. In a specific embodiment of the present invention, the solvent exchange is conducted preferably 5 times. Specifically, the sol is immersed in water and the water is changed once every 4 hours, and the process is repeated 5 times.

Figure 6:
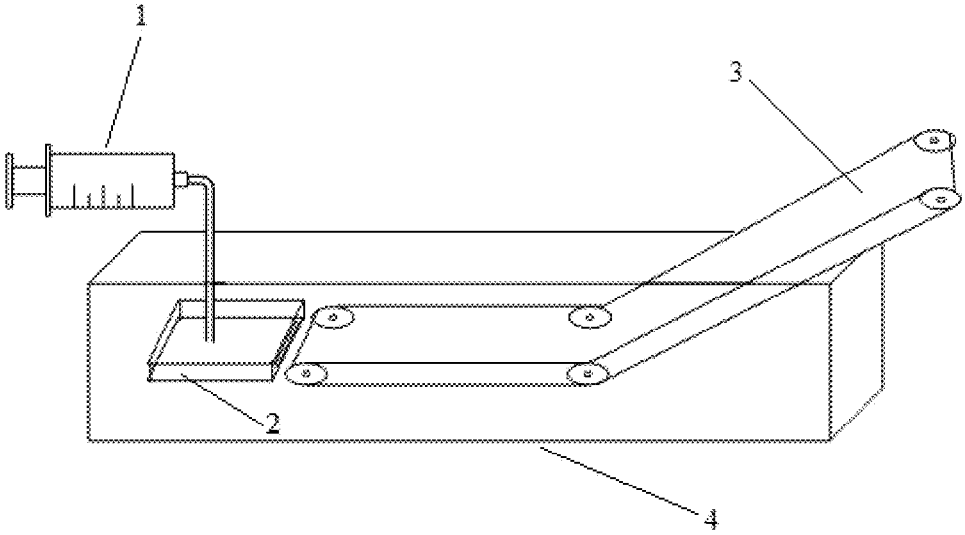
FIG. 6 is a structure diagram of a continuous injection device according to the present invention, with 1, 2, 3 and 4 representing an injector, an outlet mold, a conveyor belt and a sink respectively.

In the present invention, the operation of letting the sol pass through a continuous injection device for solvent exchange with water is a continuous preparation method. In the present invention, the continuous injection device preferably includes an injector, an outlet mold, a conveyor belt and a sink, as shown in FIG. 6. The outlet of the injector communicates with the inlet of the outlet mold, the outlet of the outlet mold is close to the conveyor belt, and the outlet mold and the conveyor belt are disposed in the sink. In the present invention, the injector is preferably controlled by an injection pump for continuous injection; and the outlet mold preferably has a rectangular cross-section. The present invention has no special requirements for the injector, injection pump, outlet mold with a rectangular cross-section and conveyor belt, and corresponding instruments well known in the art may be used. In the present invention, the operation of letting the sol pass through the continuous injection device for solvent exchange with water is as follows: the sol is continuously injected through the injector; the solvent is exchanged with water in the sink after the sol flows through the outlet mold; and the formed hydrogel is transferred out of the sink by the conveyor belt. During the continuous injection process, the speed of the injection pump is preferably set as 1 mL/min to 5 mL/min, and the speed of the conveyor belt is preferably set as 0.2 cm/s to 1 cm/s.

In the present invention, the obtained hydrogel is dried to obtain an ANF-based insulation paper. In the present invention, the drying is conducted preferably at 25° C. to 40° C., and more preferably at 30° C.; the drying is conducted preferably for 48 h to 120 h, and more preferably for 60 h to 100 h; and the drying is conducted preferably under an air atmosphere. The present invention has no special requirements for the drying method, and a method well known in the art can be used to ensure the desired drying temperature and time. In the present invention, during the drying process, the inorganic insulation materials, together with the ANF network, form a layered structure to obtain ANF-based insulation paper. The present invention has no special requirements for the thickness of the ANF-based insulation paper, and the thickness can be adjusted by adjusting the height of the mold to change the thickness of the hydrogel according to practical needs.

The present invention provides a method for preparing the ANF-based insulation paper described above. The preparation method provided in the present invention is simple, has excellent operability, and can be used for continuous preparation, thereby facilitating the realization of industrial production.

The ANF-based insulation paper and the preparation method thereof provided in the present invention will be described in detail below with reference to examples, but these examples should not be construed as limiting the claimed scope of the present invention.

EXAMPLE 1

Preparation of ANF-Based Insulation Paper (Para-ANF/Synthetic Mica Insulation Paper)

Figure 2:
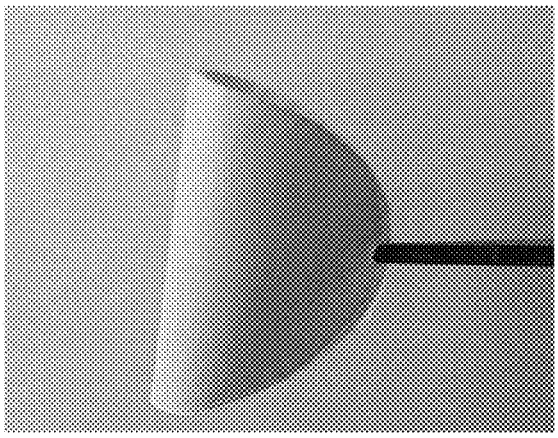
FIG. 2 is a physical appearance view of the para-ANF/synthetic mica insulation paper prepared in Example 1.

(1) 0.4 g of commercial poly(p-phenylene terephthalamide) fibers was weighed and added to a mixed solution of 19.4 mL of dimethyl sulfoxide and 0.2 g of potassium ethoxide, and the resulting mixture was stirred mechanically for 60 h to obtain a uniform dispersion of ANFs;

(2) 0.24 g of synthetic mica was weighed and added to 19.76 mL of dimethyl sulfoxide solution, and the resulting mixture was rapidly stirred mechanically for 12 h to obtain a uniform dispersion of synthetic mica;

(3) the dispersion of ANFs prepared in step (1) was mixed with the dispersion of synthetic mica prepared in step (2), the resulting mixture was stirred mechanically at 1,200 rpm for 10 h to obtain a sol, and the sol was poured into a 5.5 cm flat-bottom plastic dish;

(4) the sol in step (3) was soaked in distilled water, where dimethyl sulfoxide and potassium ethoxide in the sol diffused into water, water diffused into the sol, and then the sol was converted into hydrogel; water was changed 4 h after soaking; and the process was repeated 5 times to obtain para-ANF/synthetic mica hydrogel with a physical appearance shown in FIG. 1; and (5) the para-ANF/synthetic mica hydrogel in step (4) was dried at 25° C. for 100 h in the air to obtain an ANF-based insulation paper with 40% (in mass fraction) of synthetic mica and a physical appearance shown in FIG. 2.

Figure 3:
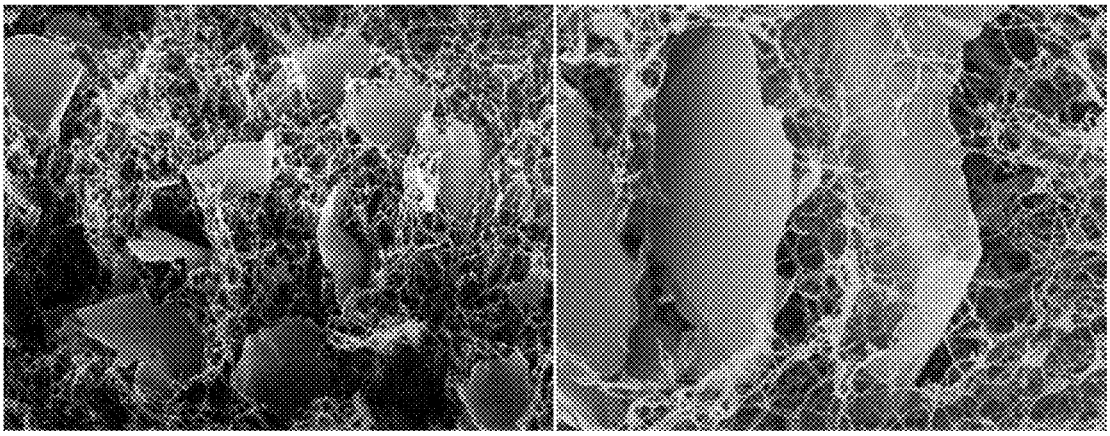
FIG. 3 shows SEM images of the para-ANF/synthetic mica hydrogel after lyophilization in Example 1, and left and right images in FIG. 3 are SEM images at different magnifications.

After lyophilized, the para-ANF/synthetic mica hydrogel obtained in step (4) of this example was observed by a scanning electron microscope, and the result was shown as the left image in FIG. 3. As shown in the left image in FIG. 3, para-ANFs have a bifurcated geometry and form a three-dimensional network structure; apertures in the fiber network have different sizes, and the synthetic mica is evenly distributed in the three-dimensional network of para-ANFs. The lyophilized para-ANF/synthetic mica hydrogel was further observed at a higher magnification, and the result was shown as the right image in FIG. 3. As shown in the right image in FIG. 3, para-ANFs are closely adhered to the surface of synthetic mica.

Figure 4:
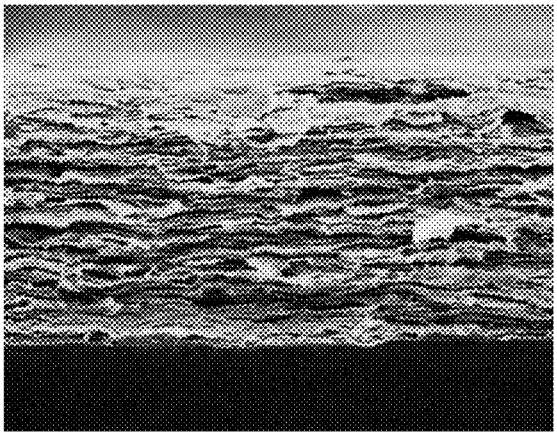
FIG. 4 is an SEM image of the para-ANF/synthetic mica insulation paper prepared in Example 1.

The para-ANF/synthetic mica insulation paper prepared in this example was observed by a scanning electron microscope, and the result was shown in FIG. 4. As shown in FIG. 4, the insulation paper obviously has an ordered layered structure.

As measured, the para-ANF/synthetic mica insulation paper prepared in this example has a thickness of 30 μm, a dielectric strength of 164 kV/mm, a tensile strength of 174.36 MPa, and a tensile toughness of 108.9 MJ/m$^3$.

Figure 5:
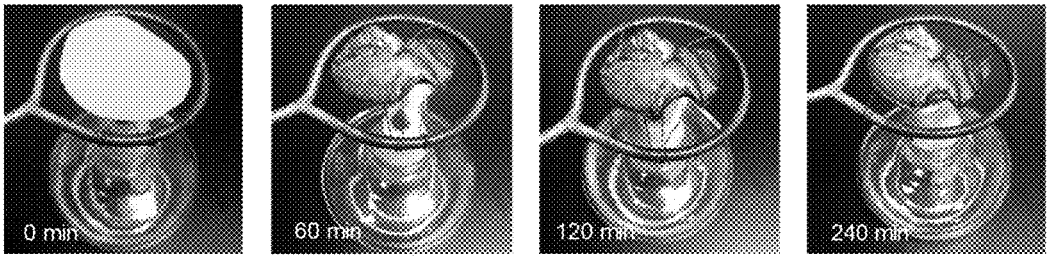
FIG. 5 is a process diagram of an experiment for burning the para-ANF/synthetic mica insulation paper prepared in Example 1 with an alcohol burner.

A burning experiment was performed on the para-ANF/synthetic mica insulation paper prepared in this example with an alcohol burner, and the experimental process was shown in FIG. 5. After the para-ANF/synthetic mica insulation paper was burned for 240 min, 60% of the initial mass remained, and the ANF network structure was still retained on the burned backside of the insulation paper, indicating that the insulation paper prepared in this example has excellent flame-resistance.

EXAMPLE 2

Preparation of ANF-Based Insulation Paper (Para-ANF/Muscovite Insulation Paper)

Figure 7:
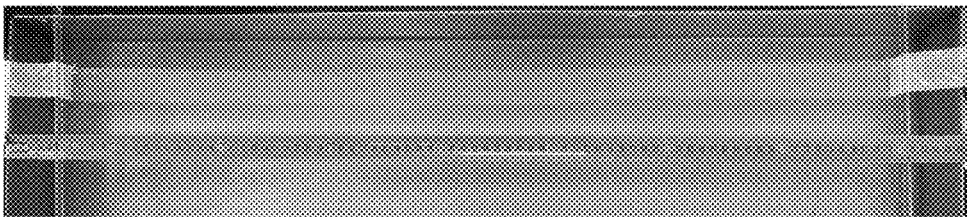
FIG. 7 is a physical appearance view of the para-ANF/muscovite hydrogel prepared in Example 2.
Figure 8:
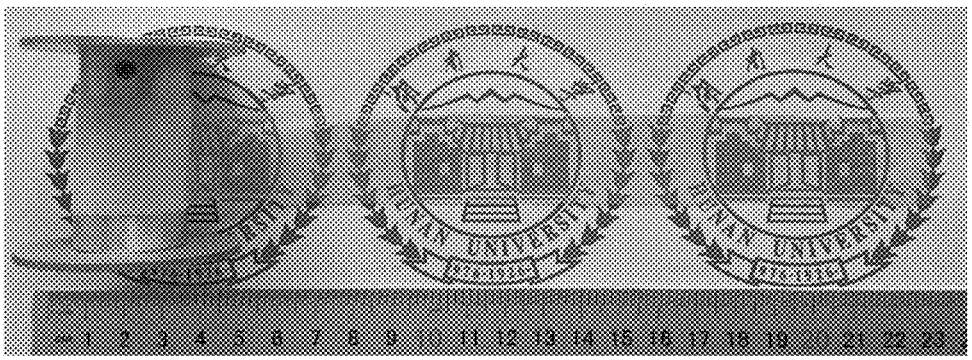
FIG. 8 is a physical appearance view of the para-ANF/muscovite insulation paper prepared in Example 2.

(1) 0.4 g of commercial poly(p-phenylene terephthalamide) fibers was weighed and added to a mixed solution of 19.2 mL of dimethyl sulfoxide and 0.4 g of potassium hydroxide, and the resulting mixture was stirred mechanically for 60 h to obtain a uniform dispersion of ANFs;

(2) 0.24 g of muscovite was weighed and added to 19.76 mL of dimethyl sulfoxide solution, and the resulting mixture was rapidly stirred mechanically for 12 h to obtain a uniform dispersion of muscovite;

(3) the dispersion of ANFs prepared in step (1) was mixed with the dispersion of muscovite prepared in step (2), and the resulting mixture was stirred mechanically at 1,200 rpm for 10 h to obtain a sol;

(4) the sol in step (3) was poured into a 60 mL injector, and the injector was fixed on an injection pump; the sol was continuously injected under the control of the injection pump, and flowed through an outlet mold with a rectangular cross-section into water to form hydrogel; and the hydrogel was transferred to the air using a conveyor belt (a device shown in FIG. 6), where the speed of the injection pump was set as 2 mL/min, and the speed of the conveyor belt was set as 0.5 cm/min;

(5) the para-ANF-based hydrogel (with a physical appearance shown in FIG. 7) in step (4) was spread out on a smooth glass surface, and then dried at 25° C. for 48 h in the air to obtain a para-ANF/muscovite insulation paper with 40% (in mass fraction) of muscovite and a physical appearance shown in FIG. 8.

The para-ANF/muscovite hydrogel and the para-ANF/muscovite insulation paper prepared in this example have microstructures similar to FIG. 3 and FIG. 4 respectively.

As measured, the para-ANF/muscovite insulation paper prepared in this example has a thickness of 40 μm, a dielectric strength of 159 kV/mm, a tensile strength of 152.5 MPa, and a tensile toughness of 90.2 MJ/m$^3$.

EXAMPLE 3

Preparation of ANF-Based Insulation Paper (Para-ANF/Boron Nitride Insulation Paper)

(1) 0.4 g of commercial poly(p-phenylene terephthalamide) fibers was weighed and added to a mixed solution of 19.4 mL of dimethyl sulfoxide and 0.2 g of potassium ethoxide, and the resulting mixture was stirred mechanically for 60 h to obtain a uniform dispersion of ANFs;

(2) 0.4 g of boron nitride was weighed and added to 30 mL of dimethyl sulfoxide solution, and the resulting mixture was stirred mechanically for 12 h to obtain a uniform dispersion of boron nitride;

(3) the dispersion of ANFs prepared in step (1) was mixed with the dispersion of boron nitride prepared in step (2); the resulting mixture was subjected to supersonic treatment at 400 W for 3 h, and then stirred mechanically at 1,200 rpm for 2 h to obtain a sol; and the sol was poured into a 5.5 cm flat-bottom plastic dish;

(4) the sol in step (3) was soaked in distilled water, where dimethyl sulfoxide and potassium ethoxide in the sol diffused into water, water diffused into the sol, and then the sol was converted into hydrogel; water was changed 4 h after soaking; and the process was repeated 5 times to obtain para-ANF/boron nitride hydrogel; and (5) the para-ANF/boron nitride hydrogel in step (4) was dried at 25° C. for 100 h in the air to obtain an ANF-based insulation paper with 40% (in mass fraction) of boron nitride.

The para-ANF/boron nitride hydrogel and the para-ANF/boron nitride insulation paper prepared in this example have microstructures similar to FIG. 3 and FIG. 4 respectively.

As measured, the para-ANF/boron nitride insulation paper prepared in this example has a thickness of 40 μm, a dielectric strength of 124 kV/mm, a tensile strength of 76 MPa, and a tensile toughness of 25 MJ/m$^3$.

EXAMPLE 4

Preparation of ANF-Based Insulation Paper (Meta-ANF/Phlogopite Insulation Paper)

(1) 0.4 g of commercial poly(m-phenylene terephthalamide) fibers was weighed and added to a mixed solution of 19.3 mL of dimethyl sulfoxide and 0.3 g of potassium tert-butoxide, and the resulting mixture was stirred mechanically for 60 h to obtain a uniform dispersion of ANFs;

(2) 0.24 g of phlogopite was weighed and added to 30 mL of dimethyl sulfoxide solution, and the resulting mixture was stirred mechanically for 12 h to obtain a uniform dispersion of phlogopite;

(3) the dispersion of ANFs prepared in step (1) was mixed with the dispersion of phlogopite prepared in step (2), the resulting mixture was stirred mechanically at 1,200 rpm for 10 h to obtain a sol, and the sol was poured into a 5.5 cm flat-bottom plastic dish;

(4) the sol in step (3) was soaked in distilled water, where dimethyl sulfoxide and potassium tert-butoxide in the sol diffused into water, water diffused into the sol, and then the sol was converted into hydrogel; water was changed 4 h after soaking; and the process was repeated 5 times to obtain meta-ANF/phlogopite hydrogel; and (5) the meta-ANF/phlogopite hydrogel in step (4) was dried at 25° C. for 100 h in the air to obtain a meta-ANF/phlogopite insulation paper with 40% (in mass fraction) of phlogopite.

The meta-ANF/phlogopite hydrogel and the meta-ANF/phlogopite insulation paper prepared in this example have microstructures similar to FIG. 3 and FIG. 4 respectively.

As measured, the meta-ANF/phlogopite insulation paper prepared in this example has a thickness of 35 μm, a dielectric strength of 95 kV/mm, a tensile strength of 62.5 MPa, and a tensile toughness of 20.4 MJ/m$^3$.

EXAMPLE 5

Preparation of ANF-Based Insulation Paper (Meta-ANF/Fluorophlogopite Insulation Paper)

(1) 0.4 g of commercial poly(m-phenylene terephthalamide) fibers was weighed and added to a mixed solution of 19.3 mL of dimethyl sulfoxide and 0.3 g of potassium ethoxide, and the resulting mixture was stirred mechanically for 60 h to obtain a uniform dispersion of ANFs;

(2) 0.24 g of fluorophlogopite was weighed and added to 19.76 mL of dimethyl sulfoxide solution, and the resulting mixture was rapidly stirred mechanically for 12 h to obtain a uniform dispersion of fluorophlogopite;

(3) the dispersion of mew ANFs prepared in step (1) was mixed with the dispersion of fluorophlogopite prepared in step (2), and the resulting mixture was stirred mechanically at 1,200 rpm for 10 h to obtain a sol;

(4) the sol in step (3) was poured into a 60 mL injector, and the injector was fixed on an injection pump; the sol was continuously injected under the control of the injection pump, and flowed through an outlet mold with a rectangular cross-section into water to form hydrogel; and the hydrogel was transferred to the air using a conveyor belt, where the speed of the injection pump was set as 2 mL/min, and the speed of the conveyor belt was set as 0.5 cm/s; and (5) the meta-ANF/fluorophlogopite hydrogel in step (4) was spread out on a smooth glass surface, and then dried at 25° C. for 48 h in the air to obtain a meta-ANF/fluorophlogopite insulation paper with 40% (in mass fraction) of fluorophlogopite.

The meta-ANF/fluorophlogopite hydrogel and the meta-ANF/fluorophlogopite insulation paper prepared in this example have microstructures similar to FIG. 3 and FIG. 4 respectively.

As measured, the meta-ANF/fluorophlogopite insulation paper prepared in this example has a thickness of 30 μm, a dielectric strength of 103 kV/mm, a tensile strength of 60.5 MPa, and a tensile toughness of 21.4 MJ/m$^3$.

COMPARATIVE EXAMPLE 1

The dry mica tape commonly used at present, Isovolta 0410, was adopted as a comparative object.

As measured, the dry mica tape, Isovolta 0410, has a dielectric strength of 10.71 kV/mm and a tensile strength of 57 MPa.

COMPARATIVE EXAMPLE 2

The aramid mica paper commonly used at present, nomex 818, was adopted as a comparative object.

As measured, the aramid mica paper, nomex 818, has a dielectric strength of 32 kV/mm and a tensile strength of 36 MPa.

In Examples 1 to 5 and Comparative Examples 1 to 2, the tensile test was performed on a Shimadzu AGS-X electronic universal testing machine, with a tensile rate of 1 mm/min, and samples having a length of 40 mm and a width of 2 mm; and the dielectric strength test was performed on an HT-20/5A breakdown voltage tester of Guilin Electrical Equipment Scientific Research Institute Co., Ltd., with an electrode diameter of 6 mm×6 mm, and circular samples having a diameter of 5 cm.

It can be seen from above examples that compared with dry mica tapes and aramid mica papers commonly used at present, the ANF-based insulation paper provided in the present invention has significantly-improved dielectric strength and tensile strength, indicating that the ANF-based insulation paper provided in the present invention has excellent electrical properties, insulation properties and mechanical properties, and can replace mica tapes and aramid mica papers on the current market for insulation, and thus the thickness for insulation can be reduced. Moreover, the preparation method provided in the present invention is simple and has excellent operability.

The above descriptions are merely preferred implementations of the present invention. It should be noted that a person of ordinary skill in the art may further make several improvements and modifications without departing from the principle of the present invention, but such improvements and modifications should be deemed as falling within the protection scope of the present invention.

What is claimed is:

1. An aramid nanofiber (ANF)-based insulation paper, comprising ANFs and inorganic insulation materials, wherein the ANFs have a bifurcated geometry and form a three-dimensional network structure, and the inorganic insulation materials are distributed in the three-dimensional network structure.

2. The ANF-based insulation paper according to claim 1, wherein the ANFs comprise para-aramid fibers and/or meta-aramid fibers, and have a diameter of 3 nm to 20 nm.

3. The ANF-based insulation paper according to claim 1, wherein the inorganic insulation materials comprise one or more of muscovite, phlogopite, fluorophlogopite, synthetic mica and boron nitride, and account for 30% to 70% of the mass of the ANF-based insulation paper.

4. A method for preparing the ANF-based insulation paper according to claim 1, comprising the following steps:

(1) mixing a strong alkali, dimethyl sulfoxide and aramid fibers to obtain a dispersion of ANFs;

(2) mixing dimethyl sulfoxide and inorganic insulation materials to obtain a dispersion of inorganic insulation materials;

(3) mixing the dispersion of ANFs and the dispersion of inorganic insulation materials to obtain a sol;

(4) performing solvent exchange on the sol with water to obtain a hydrogel; and (5) drying the hydrogel to obtain an ANF-based insulation paper;

wherein, steps (1) and (2) can be performed in any order.

5. The preparation method according to claim 4, wherein the strong alkali in step (1) is one or more of potassium hydroxide, potassium ethoxide and potassium tert-butoxide; the strong alkali and dimethyl sulfoxide are used at a mass ratio of 1:(9-300); and the strong alkali and aramid fibers are used at a mass ratio of 1:(1-3).

6. The preparation method according to claim 4, wherein, in step (2), dimethyl sulfoxide and inorganic insulation materials are used at a mass ratio of 1:(0.003-0.05).

7. The preparation method according to claim 4, wherein, in step (3), the dispersion of ANFs and the dispersion of inorganic insulation materials are used at a mass ratio of 1:(0.5-3).

8. The preparation method according to claim 4, wherein, the performing solvent exchange on the sol with water in step (4) specifically comprises: pouring the sol into a mold and then immersing the mold in water for solvent exchange; or, letting the sol pass through a continuous injection device for solvent exchange with water.

9. The preparation method according to claim 8, wherein the continuous injection device comprises an injector, an outlet mold, a conveyor belt, and a sink, wherein the outlet of the injector communicates with the inlet of the outlet mold, the outlet of the outlet mold is close to the conveyor belt, and the outlet mold and the conveyor belt are disposed in the sink;

and in application, the sol is continuously injected through the injector; the solvent is exchanged with water in the sink after the sol flows through the outlet mold; and the formed hydrogel is transferred out of the sink by the conveyor belt.

10. The preparation method according to claim 4, wherein the drying in step (5) is performed at 25° C. to 40° C. for 48 h to 120 h.

11. A method for preparing the ANF-based insulation paper according to claim 2, comprising the following steps:

(1) mixing a strong alkali, dimethyl sulfoxide and aramid fibers to obtain a dispersion of ANFs;

(2) mixing dimethyl sulfoxide and inorganic insulation materials to obtain a dispersion of inorganic insulation materials;

(3) mixing the dispersion of ANFs and the dispersion of inorganic insulation materials to obtain a sol;

(4) performing solvent exchange on the sol with water to obtain a hydrogel; and (5) drying the hydrogel to obtain an ANF-based insulation paper;

wherein, steps (1) and (2) can be performed in any order.

12. The preparation method according to claim 11, wherein the strong alkali in step (1) is one or more of potassium hydroxide, potassium ethoxide and potassium tert-butoxide; the strong alkali and dimethyl sulfoxide are used at a mass ratio of 1:(9-300); and the strong alkali and aramid fibers are used at a mass ratio of 1:(1-3).

13. The preparation method according to claim 11, wherein, in step (2), dimethyl sulfoxide and inorganic insulation materials are used at a mass ratio of 1:(0.003-0.05).

14. The preparation method according to claim 11, wherein, in step (3), the dispersion of ANFs and the dispersion of inorganic insulation materials are used at a mass ratio of 1:(0.5-3).

15. The preparation method according to claim 11, wherein, the performing solvent exchange on the sol with water in step (4) specifically comprises: pouring the sol into a mold and then immersing the mold in water for solvent exchange; or, letting the sol pass through a continuous injection device for solvent exchange with water.

16. A method for preparing the ANF-based insulation paper according to claim 3, comprising the following steps:

(1) mixing a strong alkali, dimethyl sulfoxide and aramid fibers to obtain a dispersion of ANFs;

(2) mixing dimethyl sulfoxide and inorganic insulation materials to obtain a dispersion of inorganic insulation materials;

(3) mixing the dispersion of ANFs and the dispersion of inorganic insulation materials to obtain a sol;

(4) performing solvent exchange on the sol with water to obtain a hydrogel; and (5) drying the hydrogel to obtain an ANF-based insulation paper;

wherein, steps (1) and (2) can be performed in any order.

17. The preparation method according to claim 16, wherein the strong alkali in step (1) is one or more of potassium hydroxide, potassium ethoxide and potassium tert-butoxide; the strong alkali and dimethyl sulfoxide are used at a mass ratio of 1:(9-300); and the strong alkali and aramid fibers are used at a mass ratio of 1:(1-3).

18. The preparation method according to claim 16, wherein, in step (2), dimethyl sulfoxide and inorganic insulation materials are used at a mass ratio of 1:(0.003-0.05).

19. The preparation method according to claim 16, wherein, in step (3), the dispersion of ANFs and the dispersion of inorganic insulation materials are used at a mass ratio of 1:(0.5-3).

20. The preparation method according to claim 16, wherein, the performing solvent exchange on the sol with water in step (4) specifically comprises: pouring the sol into a mold and then immersing the mold in water for solvent exchange; or, letting the sol pass through a continuous injection device for solvent exchange with water.

* * * * *